US007174953B2

(12) United States Patent
Chiba

(10) Patent No.: US 7,174,953 B2
(45) Date of Patent: Feb. 13, 2007

(54) STACKING-TYPE, MULTI-FLOW, HEAT EXCHANGER

(75) Inventor: Tomohiro Chiba, Isesaki (JP)

(73) Assignee: Sanden Corporation, Gunma (JP)

( * ) Notice: Subject to any disclaimer, the term of this patent is extended or adjusted under 35 U.S.C. 154(b) by 64 days.

(21) Appl. No.: 10/979,142

(22) Filed: Nov. 3, 2004

(65) Prior Publication Data

US 2005/0098310 A1 May 12, 2005

(30) Foreign Application Priority Data

Nov. 11, 2003 (JP) ..... 2003-381546

(51) Int. Cl.
*F28D 1/03* (2006.01)

(52) U.S. Cl. ..... 165/153; 165/178

(58) Field of Classification Search ..... None
See application file for complete search history.

(56) References Cited

U.S. PATENT DOCUMENTS 5,169,178 A * 12/1992 Hunzinger ..... 285/26
5,630,326 A * 5/1997 Nishishita et al. ..... 62/299
6,196,306 B1 * 3/2001 Aikawa et al. ..... 165/178
6,220,343 B1 * 4/2001 Ichiyanagi ..... 165/153
6,543,530 B2 * 4/2003 Watanabe ..... 165/178

* cited by examiner

*Primary Examiner*—Allen J. Flanigan
(74) *Attorney, Agent, or Firm*—Baker Botts L.L.P.

(57) ABSTRACT

A stacking-type, multi-flow, heat exchanger includes a plurality of heat transfer tubes and fins stacked alternately, and a pair of tanks provided at either end of the heat transfer tubes. One of the tanks has an inlet tank portion and an outlet tank portion for the introduction and the discharge of a heat exchange medium to the heat exchanger. The heat exchanger has a flange member connected to the one of the tanks, the flange member has a flange body, an inlet pipe communicating with the inlet tank portion and an outlet pipe communicating with the outlet tank portion, and at least one of the inlet and outlet pipes is formed separately from the flange body. A passage for introducing heat exchange medium from the inlet pipe to the inlet tank portion and a passage for discharging heat exchange medium from the outlet tank portion to the outlet pipe are arranged in a thickness direction of the heat exchanger in parallel to each other. In this structure, the heat exchanger may be made to be thinner, smaller, and lighter than known heat exchangers.

7 Claims, 6 Drawing Sheets

STACKING-TYPE, MULTI-FLOW, HEAT EXCHANGER

BACKGROUND OF THE INVENTION

This application claims the benefit of Japanese Patent Application No. 2003-381546, filed Nov. 11, 2003, which is incorporated herein by reference.

1. Field of the Invention

The present invention relates to a stacking-type, multi-flow, heat exchanger comprising heat transfer tubes and fins stacked alternately. Specifically, the present invention relates to an improved structure of a stacking-type, multi-flow, heat exchanger suitable as a heat exchanger, in particular, as an evaporator, for use in an air conditioner for vehicles.

2. Description of Related Art

A stacking-type, multi-flow, heat exchanger having alternately stacked heat transfer tubes and fins is known in the art, for example, as an evaporator for an air conditioner in vehicles. Recently, however, size limitations imposed on air conditioners for smaller vehicles have become more restrictive as a result of the reduced space available in vehicles. In particular, for an evaporator, the size limitations have been reduced for both the width of the evaporator in the stacking or transverse direction of the tubes and fins and for the thickness of the evaporator in the air flow direction. To satisfy such requirements, a structure of a stacking-type, multi-flow, heat exchanger has been proposed, in which a side tank for forming a fluid introduction passage and a fluid discharge passage are provided at an end of a heat exchanger core in the stacking direction of the tubes and fins. A heat exchange medium is introduced into and discharged from the heat exchanger core at a side of the heat exchanger by connecting a flange member having fluid introduction and discharge pipes to the side tank, and the thickness of the heat exchanger is reduced by employing a structure with no flange and no fluid introduction and discharge pipes on the front and rear surfaces of the heat exchanger (for example, Japanese Patent No. 2000-283685).

Further, in such a structure, in order to further reduce the thickness of the heat exchanger, and because the flange member may protrude from the heat exchanger core, a structure, as depicted in FIGS. 7–10, has been proposed, in which the flange member is disposed to be inclined obliquely relative to the height direction (the tube extending direction) of the heat exchanger (for example, Japanese Patent No. 2001-56164).

In FIGS. 7–10, a heat exchanger 100 has a heat exchanger core 103 formed by heat transfer tubes 101 and outer fins 102 stacked alternately. Tanks 104 and 105 are provided at either end of heat transfer tubes 101 (the upper and lower ends in FIG. 7), respectively. Each heat transfer tube 101 is formed by a pair of tube plates 106 and 107 connected to each other, and tanks 104 and 105 are formed at either end of heat transfer tubes 101 by stacking a plurality of heat transfer tubes 101.

An end plate 108 is connected to an outermost fin 102 in the stacking or transverse directions by brazing. A side tank 109, as depicted in FIG. 10, is connected to end plate 108. A flange member 111 is connected to side tank 109 via a flange stay 110. Flange member 111 includes an inlet pipe 112 for introducing a heat exchange medium into an inlet tank portion of tank 104 through side tank 109, an outlet pipe 113 for discharging heat exchange medium from an outlet tank portion of tank 104 through side tank 109, and a flange body 114. As depicted in FIG. 9, inlet and outlet pipes 112 and 113 and flange body 114 are formed integrally. For example, flange member 111 may be formed by machining a single block of material.

As depicted in FIGS. 9 and 10, an insertion hole 115, into which inlet pipe 112 of flange member 111 is inserted, and an insertion hole 116, into which outlet pipe 113 of flange member 111 is inserted, are formed in side tank 109. In FIG. 10, insertion hole 115 is disposed at a right lower position relative to insertion hole 116. Therefore, as depicted in FIG. 8, flange member 111 is connected to side tank 109 at an inclined orientation relative to the height direction h of heat exchanger 100. In such a structure, while preventing inconvenience caused by the protrusion of flange member 111 in the thickness direction t of heat exchanger 100 (in the left/right direction of FIG. 8, namely, an air flow direction as depicted by an arrow in FIG. 8), a further reduction in the size of heat exchanger 100 may be achieved.

In such a structure, however, as depicted by an arrow line in FIG. 7, the heat exchange medium introduced into inlet pipe 112 of flange member 111 impinges on end plate 108 forming one side wall of side tank 109, the flow direction of the heat exchange medium is changed by an angle of 90 degrees, the heat exchange medium flows upward in side tank 109, the flow direction of the heat exchange medium is changed by an angle of 90 degrees again at an upper portion in side tank 109, and then, the heat exchange medium flows into tank 104. Such a flow path may increase the pressure loss. Further, although the thickness of side tank 109 is increased in order to ensure sufficient cross-sectional area of the passage in side tank 109 to suppress the pressure loss in the side tank 109, in this case, the width of heat exchanger 100 (the stacking or transverse direction s of heat exchanger 100 in the left/right direction in FIG. 7) may increase. Consequently, controlling pressure loss in heat exchanger 100 may interfere with efforts to reduce heat exchanger size, conserve space for heat exchanger installation, and reduce heat exchanger weight. Moreover, because flange member 111 may be processed by machining a single block of material, it may be necessary to provide a certain wide gap between inlet pipe 112 and outlet pipe 113 for insertion of a turning tool. Therefore, it may be difficult to reduce a length l (depicted in FIG. 8) of flange member 111 in the arrangement direction of the inlet and outlet pipes, and it may be difficult to respond to the requirement for a further reductions in the size of heat exchanger 100.

SUMMARY OF THE INVENTION

Accordingly, it is an object of the present invention to provide an improved structure of stacking-type, multi-flow, heat exchangers, and especially, high performance, stacking-type, multi-flow heating exchangers, which may achieve a reduction in heat exchanger size and respond to the requirements for conserving installation space and reducing the weight of the heat exchanger while reducing the pressure loss therein.

To achieve the foregoing and other objects, the structure of a stacking-type, multi-flow, heat exchanger, according to the present invention, is provided. The stacking-type, multi-flow, heat exchanger, comprises a heat exchanger core comprising a plurality of heat transfer tubes and a plurality of fins, which are stacked alternately, and a pair of tanks, each provided at an end of the plurality of heat transfer tubes. A first tank of the pair of tanks comprises an inlet tank portion through which an heat exchange medium is introduced into the heat exchanger core and an outlet tank portion through which the heat exchange medium is discharged from the heat exchanger core. The heat exchanger comprises a flange member connected to the first tank. The flange member comprises a flange body, an inlet pipe communicating with the inlet tank portion and an outlet pipe communicating with the outlet tank portion, and at least one of the inlet pipe and the outlet pipe is formed separately from the flange body. The heat exchanger further comprises a first passage for introducing the heat exchange medium from the inlet pipe to the inlet tank portion and a second passage for discharging heat exchange medium from the outlet tank portion to the outlet pipe. The first and second passages are arranged in a thickness direction of the heat exchanger in parallel to each other. Further, it is preferred that the first and second passages are formed as straight passages, respectively.

In such a stacking-type, multi-flow, heat exchanger, because at least one of the inlet pipe and the outlet pipe is formed separately from the flange body, it is not necessary to ensure a wide gap between the inlet pipe and outlet pipe, as in the known structures of an integral flange member for machining. Namely, the gap between the inlet and outlet pipes in the present invention may be reduced significantly as compared with that in known structures. Therefore, because the dimension of the flange member in its longitudinal direction (between the inlet pipe and outlet pipe) may be reduced by the amount of the reduction described above as compared with that in the known structures, even if the longitudinal direction of the flange member is predetermined in the thickness direction of the heat exchanger (in an air flow direction), the flange member may be prevented from protruding from the heat exchanger in its thickness direction.

Further, by connecting the flange member, so that the longitudinal direction of the flange member is predetermined in the thickness direction of the heat exchanger, the first and second passages may be arranged or oriented in the thickness direction of the heat exchanger, and both the first and second passages may be formed as straight passages. Thus, the pressure loss in the first and second passages may be reduced significantly by this structure, as compared with known structures having an angled passage, as depicted in FIG. 7. Moreover, by forming the first and second passages as straight passages, a side tank may be omitted. By omitting the side tank, the pressure loss may be reduced further, and at the same time, the width of the heat exchanger in the stacking or transverse direction of the tubes and fins may be reduced. In addition, if the side tank is omitted, the weight and the cost for manufacture of the heat exchanger may be reduced further.

In the present invention, the inlet pipe and the outlet pipe may be formed separately from each other. Therefore, either the inlet pipe or the outlet pipe may be formed integrally with the flange body, and by such a structure, the number of parts and the cost for manufacture may be reduced. In another embodiment, however, the inlet pipe, the outlet pipe, and the flange body also may be formed separately from one another.

In the stacking-type, multi-flow, heat exchanger, according to the present invention, each of the heat transfer tubes may be formed by a pair of tube plates. The tanks may be formed integrally with the plurality of heat transfer tubes. Although, according to the present invention, the respective parts of the heat exchanger may be brazed as a whole in a furnace after assembly; usually, the flange member is connected to an end plate, which is provided as an outermost layer of the heat exchanger core in the stacking or transverse direction of the heat transfer tubes and fins, via a flange stay. If one or more claws are provided on the flange stay, the flange stay may be fixed to the end plate temporarily and readily by caulking the claws.

In the stacking-type, multi-flow, heat exchanger, according to the present invention, the flange member may be connected to the heat exchanger core, so that the longitudinal direction of the flange member is predetermined in the thickness direction of the heat exchanger, while preventing the protrusion of the flange member from the heat exchanger. Further, the first and second passages for introducing and discharging the heat exchange medium may be arranged in the thickness direction of the heat exchanger in parallel to each other, and the first and second passages may be formed as straight passages. Consequently, the thickness of the heat exchanger may be reduced, and the pressure loss in the first and second passages may be reduced. Moreover, the side tank may be omitted, and the width of the heat exchanger in the stacking or transverse direction of the tubes and fins also may be reduced. Therefore, the heat exchanger may be made smaller, lighter, and at a lower cost.

The stacking-type, multi-flow, heat exchanger, according to the present invention, may be applied to any tube-and-fin stacking-type, multi-flow, heat exchanger, and is especially suitable as an evaporator for use in an air conditioner for vehicles.

Other objects, features, and advantages of the present invention will be apparent to persons of ordinary skill in the art from the following detailed description of preferred embodiments of the present invention and the accompanying drawings.

BRIEF DESCRIPTION OF THE DRAWINGS

For a more complete understanding of the present invention; the needs satisfied thereby; and the objects, features, and advantages thereof; reference now is made to the following description taken in connection with the accompanying drawings.

DETAILED DESCRIPTION OF PREFERRED EMBODIMENTS

Figure 1:
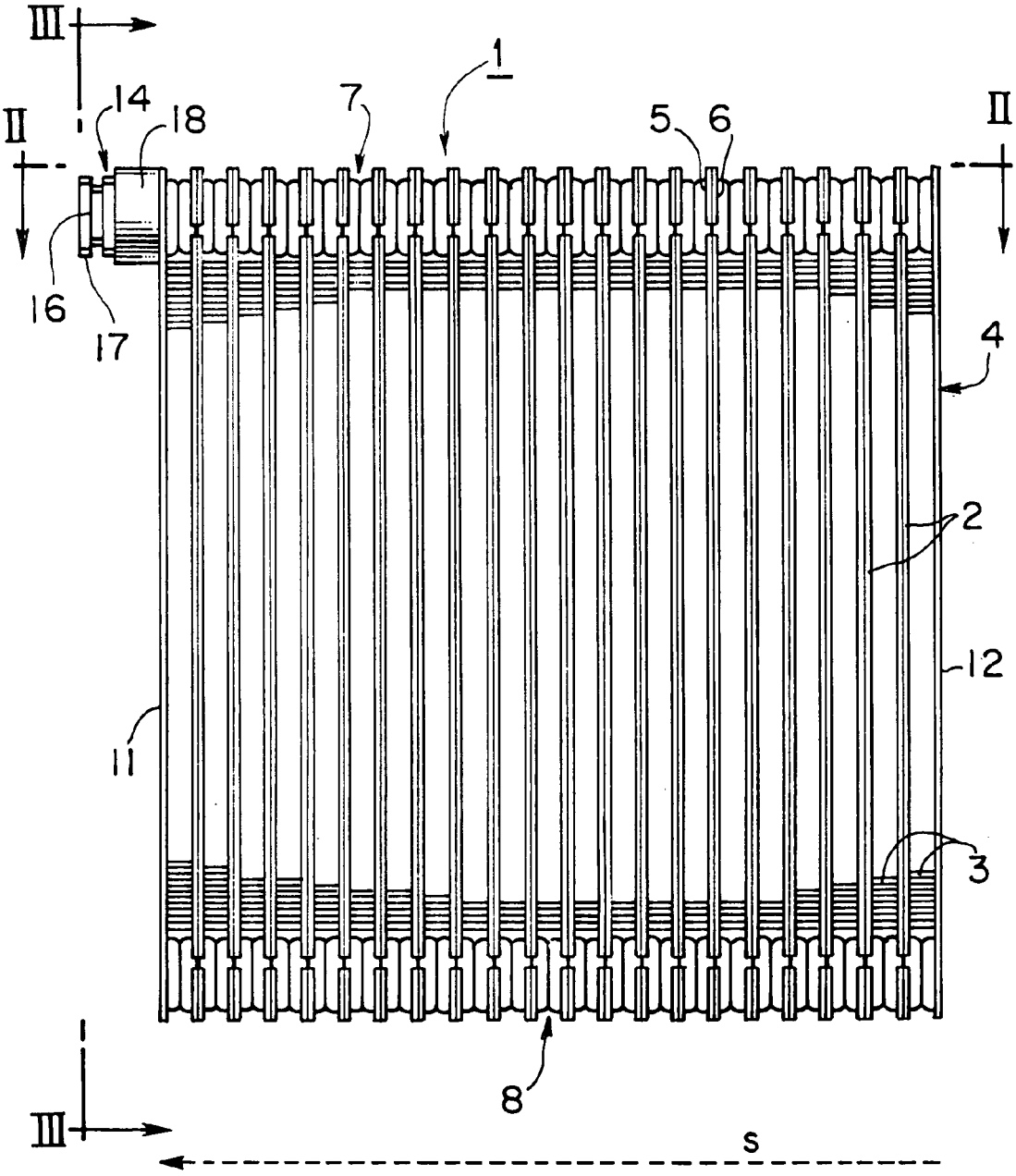
FIG. 1 is a side view of a stacking-type, multi-flow, heat exchanger, according to an embodiment of the present invention.
Figure 2:
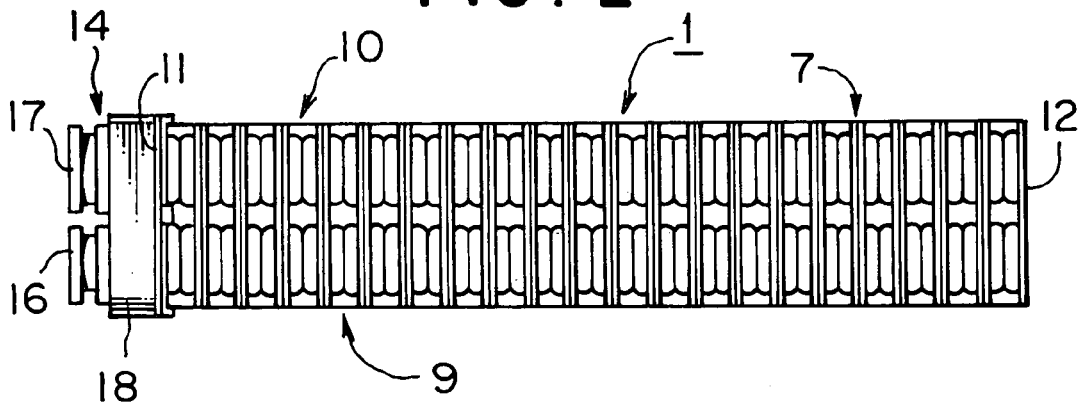
FIG. 2 is a plan view of the heat exchanger depicted in FIG. 1, as viewed along Line II—II of FIG.1.

Referring to FIGS. 1–6, a heat exchanger is depicted according to an embodiment of the present invention. Heat exchanger 1 is constructed as a stacking-type, multi-flow, heat exchanger. As depicted, heat exchanger 1 comprises a heat exchanger core 4 formed by a plurality of heat transfer tubes 2 and a plurality of outer fins 3 stacked alternately. Each heat transfer tube 2 is formed by connecting (e.g., brazing) a pair of tube plates 5 and 6, and forming therebetween a fluid passage for heat exchange medium. In addition, an inner fin may be provided in heat transfer tube 2 within this fluid passage.

Tanks 7 and 8 are provided at either end of heat transfer tubes 2, respectively. In this embodiment, these tanks 7 and 8 are formed integrally with the plurality of heat transfer tubes 2 by stacking the heat transfer tubes 2. One of tanks 7 and 8 is divided into an inlet tank portion 9 for introducing heat exchange medium into heat exchanger core 4 and an outlet tank portion 10 for discharging heat exchange medium from heat exchanger core 4. In the depicted embodiment, tank 7 is the divided tank.

Figure 4:
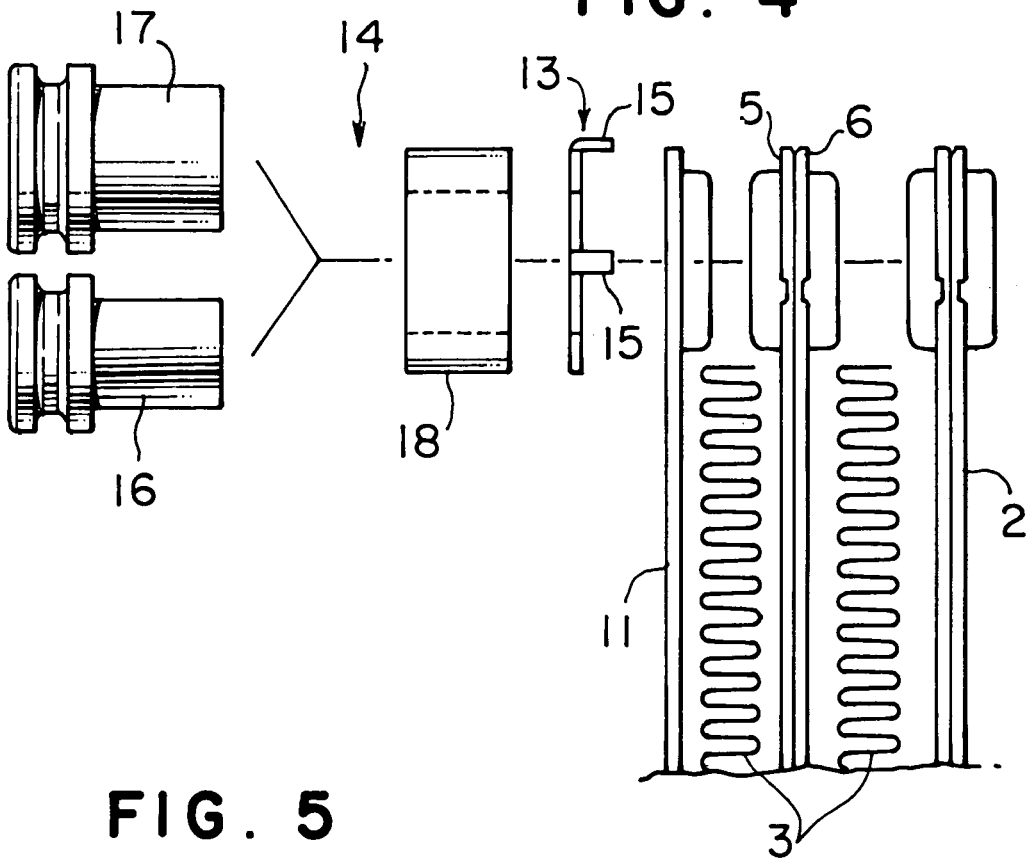
FIG. 4 is an enlarged and exploded, side view of a flange connecting portion of the heat exchanger depicted in FIG. 1.
Figure 6:
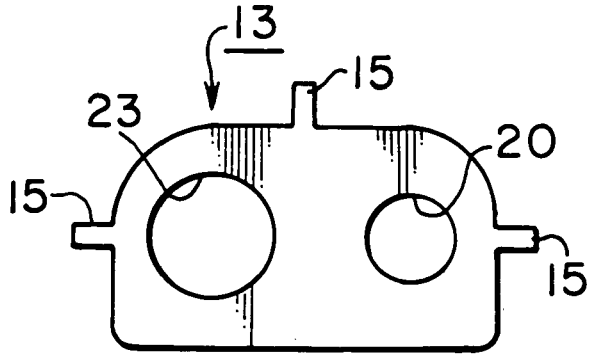
FIG. 6 is a plan view of a flange stay of the heat exchanger depicted in FIG. 1.
Figure 7:
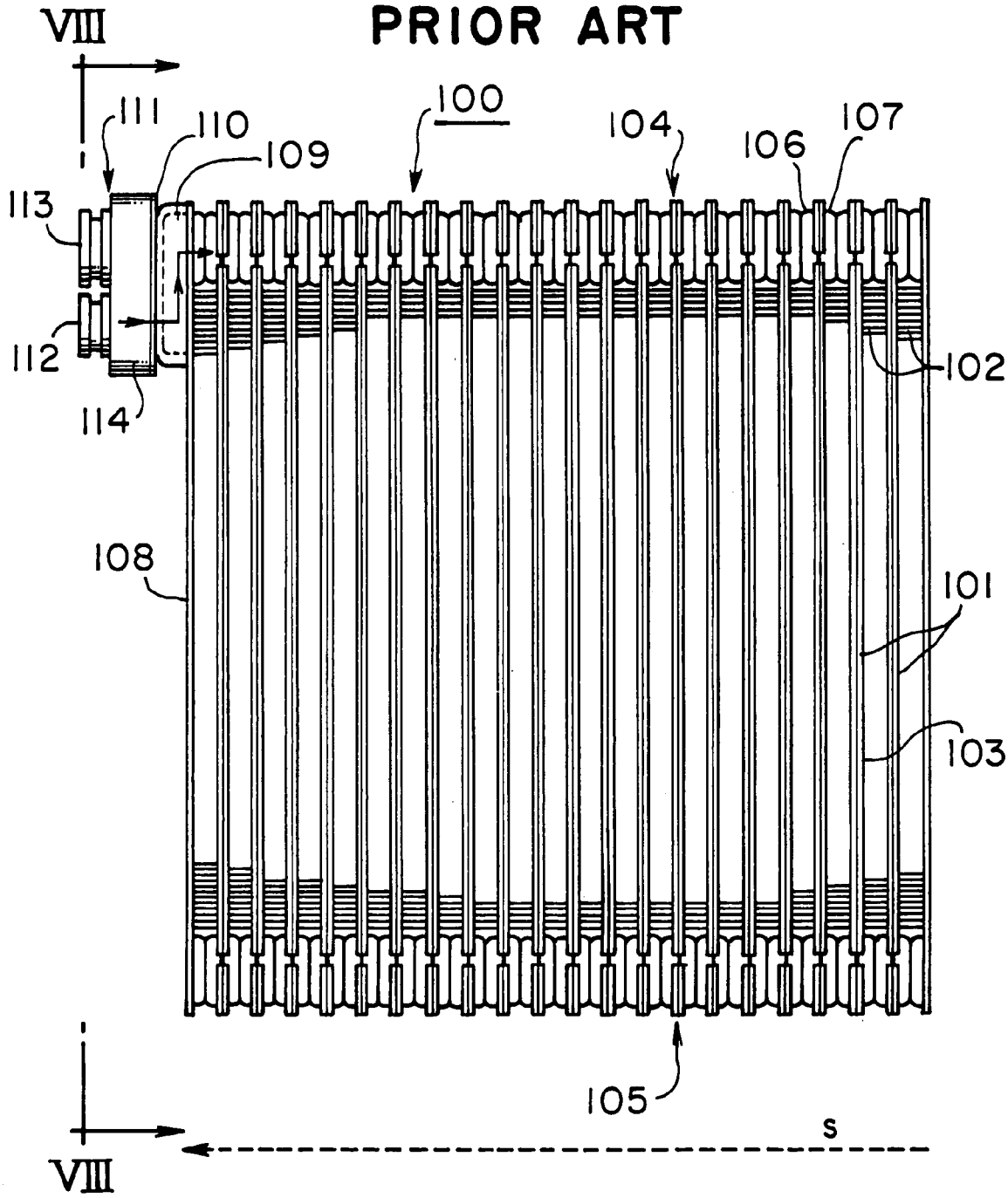
FIG. 7 PRIOR ART
FIG. 7 is a side view of a known stacking-type, multi-flow heat, exchanger.
Figure 8:
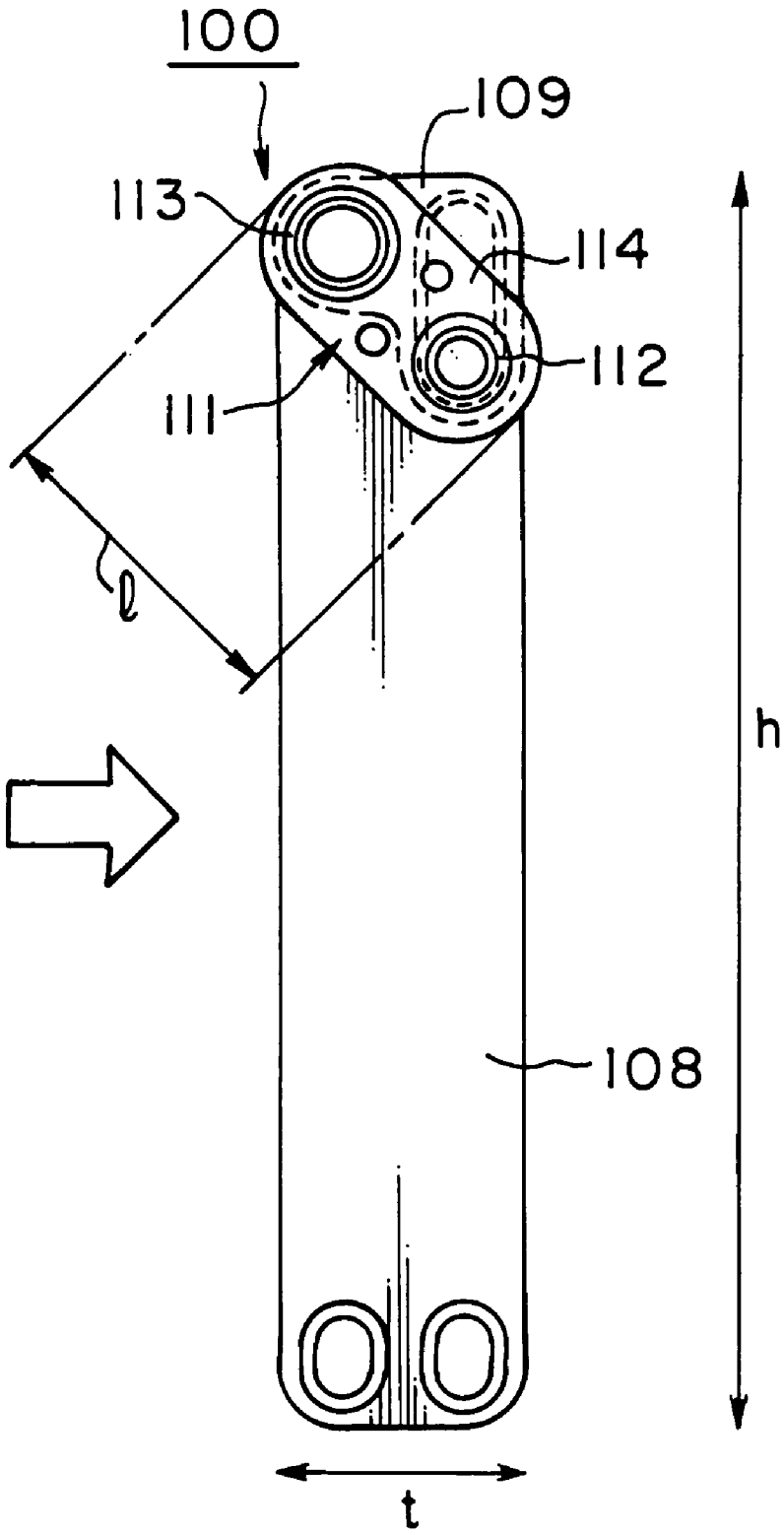
FIG. 8 PRIOR ART
FIG. 8 is an end view of the heat exchanger depicted in FIG. 7, as viewed along Line VIII—VIII of FIG. 7.
Figure 9:
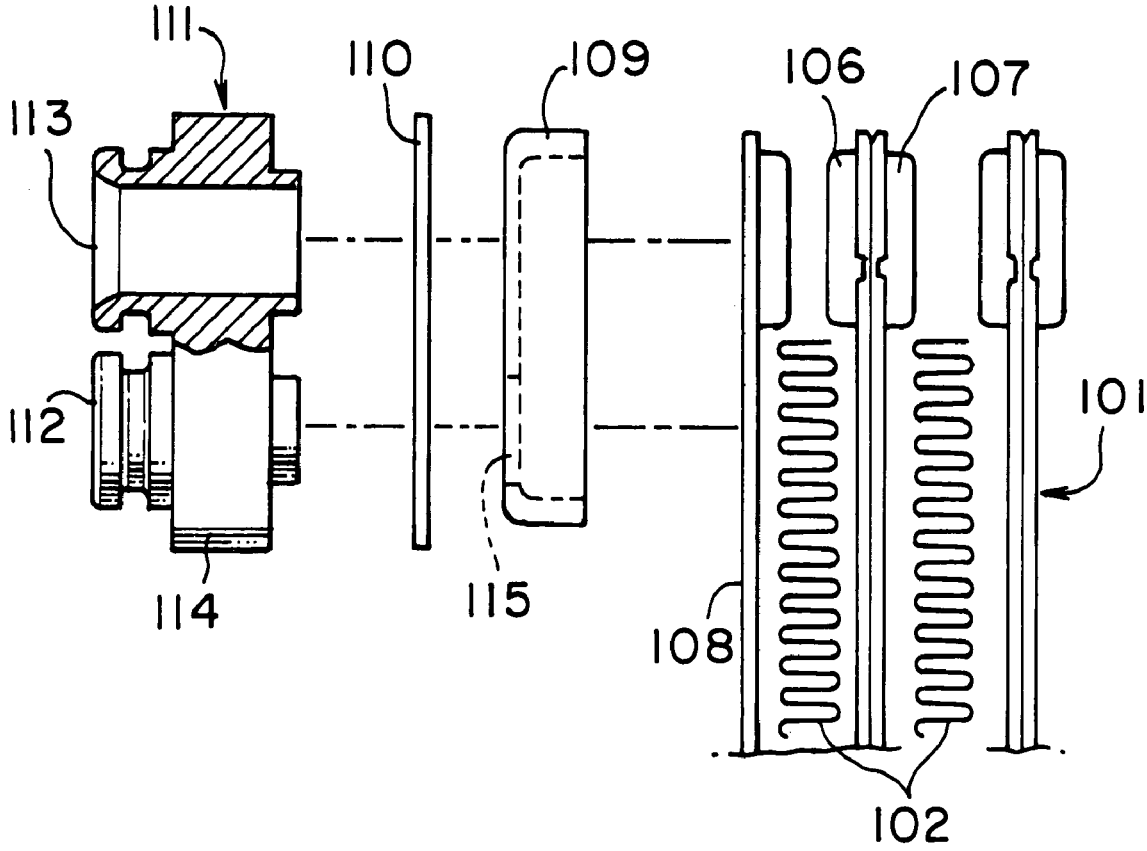
FIG. 9 PRIOR ART
FIG. 9 is an enlarged and exploded, side view of a flange connecting portion of the heat exchanger depicted in FIG. 7.
Figure 10:
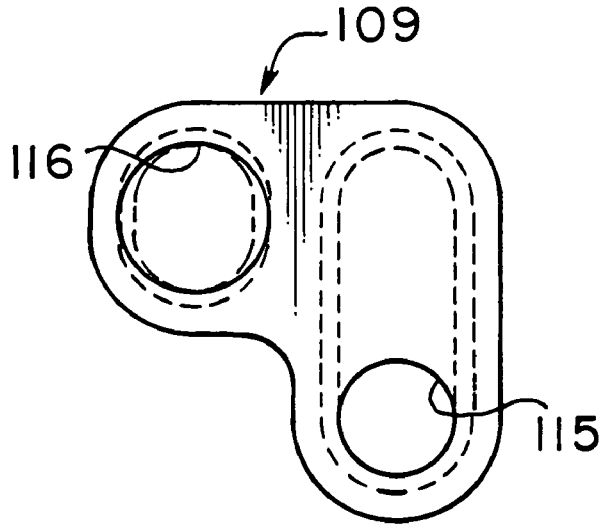
FIG. 10 PRIOR ART
FIG. 10 is a plan view of a side tank of the heat exchanger depicted in FIG. 7.

End plates 11 and 12 are provided on and connected (e.g., brazed) to both outermost fins 3 in the stacking or transverse direction s of tubes 2 and fins 3, respectively. A flange member 14 is connected (e.g., brazed) to end plate 11 via a flange stay 13, which is formed as depicted in FIG. 6. Referring to FIG. 4, claws 15 are disposed on flange stay 13, so that, for example, when the assembled parts of heat exchanger 1 are placed in a furnace for brazing, by caulking claws 15 onto end plate 11, flange stay 13 may be readily fixed temporarily to end plate 11.

Flange member 14 comprises an inlet pipe 16, an outlet pipe 17, and a flange body 18. These components may be formed separately from one another, as in the embodiment depicted in FIGS. 4 and 5. Inlet pipe 16 is inserted into a hole 19 formed in flange body 18 and a hole 20 formed in flange stay 13 and communicates with inlet tank portion 9 via a hole 21 provided through end plate 11. On the other hand, outlet pipe 17 is inserted into a hole 22 formed in flange body 18 and a hole 23 formed in flange stay 13 and communicates with outlet tank portion 10 via a hole 24 provided through end plate 11. Inlet pipe 16, outlet pipe 17, and flange body 18 form flange member 14 and may be brazed to each other. Before such brazing, inlet and outlet pipes 16 and 17 may be readily fixed temporarily to flange body 18 by inserting the inlet and outlet pipe 16 and 17 into holes 19 and 22 formed in flange body 18 and by enlarging the diameters thereof In addition, inlet and outlet pipes 16 and 17 may be formed by machining.

Figure 3:
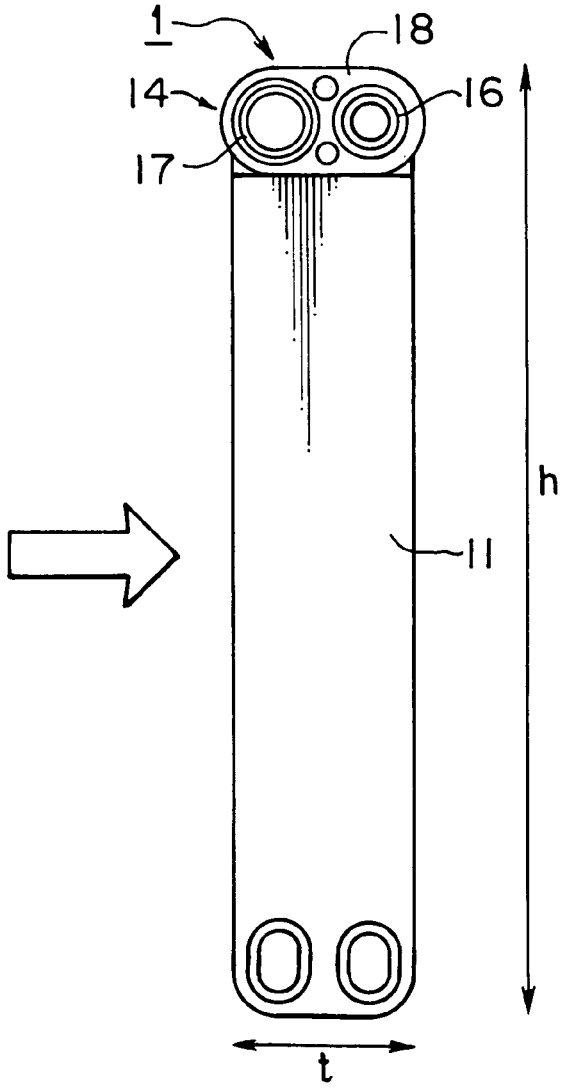
FIG. 3 is an end view of the heat exchanger depicted in FIG. 1, as viewed along Line III—III of FIG. 1.
Figure 5:
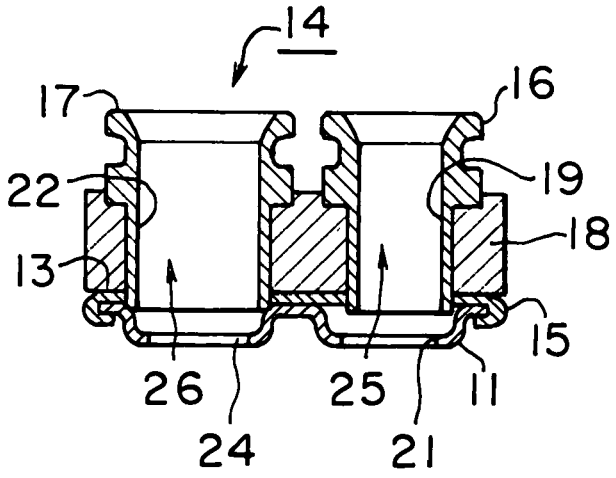
FIG. 5 is a sectional view of a flange member of the heat exchanger depicted in FIG. 1.

Further, flange member 14 is connected to heat exchanger core 4, so that its longitudinal direction is predetermined along the thickness direction t of heat exchanger 1, as depicted in FIG. 3. Inlet and outlet pipes 16 and 17 are arranged in the thickness direction t of heat exchanger 1 in parallel to each other. As depicted in FIG. 5, first passage 25 for introducing the heat exchange medium from inlet pipe 16 to inlet tank portion 9 and second passage 26 for discharging the heat exchange medium from outlet tank portion 10 to outlet pipe 17 then are arranged in the thickness direction of heat exchanger 1 in parallel to each other. These first and second passages 25 and 26 are formed as straight passages, respectively.

In this embodiment, because inlet pipe 16, outlet pipe 17, and flange body 18 are formed separately from one another, a wide gap need not be established between inlet and outlet pipes 16 and 17, as in known structures, to satisfy manufacturing requirements. In particular, when the respective parts of flange member 14 are formed separately from each other and these parts are connected to each other, the gap between inlet and outlet pipes 16 and 17 may be reduced significantly as compared with that in known structures. Consequently, because the longitudinal dimension of flange member 14 may be reduced by the reduced amount of the gap, even if the reduction in thickness of heat exchanger 1 is increased, flange member 14 may be connected at an orientation in which the longitudinal direction of the flange member 14 is predetermined along the thickness direction of heat exchanger 1, and the protrusion of the flange member 14 from the heat exchanger 1 may be prevented.

As described above, if flange member 14 is connected to heat exchanger core 4, so that the longitudinal direction of the flange member 14 is predetermined along the thickness direction of heat exchanger 1, heat exchange medium introduction passage 25 and heat exchange medium discharge passage 26 may be arranged in the thickness direction of heat exchanger 1 in parallel to each other, and passages 25 and 26 may form straight passages, respectively. Therefore, the pressure loss in the passages 25 and 26 may be reduced significantly. Moreover, by forming the passages 25 and 26 as straight passages, a side tank may be omitted. If a side tank is omitted, the introduction of the heat exchange medium into inlet tank portion 9 and the discharge of the heat exchange medium from outlet tank portion 10 may be carried out smoothly with a reduced pressure loss. Thus, a side tank may be omitted, and by this omission of the side tank, the width of heat exchanger 1 may be reduced, and the dimensions of heat exchanger 1 may be reduced. Further, this omission of a side tank may contribute to the reduction in the weight and cost of heat exchanger 1.

Although the respective parts of inlet pipe 16, outlet pipe 17, and flange body 18 are formed separately from one another in the above-described embodiments, the purpose of the present invention may be achieved by forming at least one of inlet and outlet pipes 16 and 17 separately from flange body 18. Therefore, either inlet pipe 16 or outlet pipe 17 may be formed integrally with flange body 18.

While the invention has been described in connection with preferred embodiments, it will be understood by those skilled in the art that variations and modifications of the preferred embodiments described above may be made without departing from the scope of the invention. Other embodiments will be apparent to those skilled in the art from a consideration of the specification or from a practice of the invention disclosed herein. It is intended that the specification and the described examples are exemplary only, with the true scope of the invention indicated by the following claims.

What is claimed is:

1. A stacking-type, multi-flow, heat exchanger comprising a heat exchanger core comprising a plurality of heat transfer tubes and a plurality of fins, which are stacked alternately, and a pair of tanks, each provided at an end of said plurality of heat transfer tubes, a first tank of said tanks comprising an inlet tank portion through which a heat exchange medium is introduced into said heat exchanger core, and an outlet tank portion, through which said heat exchange medium is discharged from said heat exchanger core, said heat exchanger comprising:

a flange member connected to said first tank, said flange member comprising a flange body, an inlet pipe portion communicating with said inlet tank portion and an outlet pipe communicating with said outlet tank portion, at least one of said inlet pipe and said outlet pipe being formed separately from said flange body; and a first passage for introducing said heat exchange medium from said inlet pipe to said inlet tank portion and a second passage for discharging said heat exchange medium from said outlet tank portion to said outlet pipe, said first and second passages being arranged in a thickness direction of said heat exchanger in parallel to each other, wherein said first passage is substantially concentric with an inlet hole formed through an end plate of said plurality of heat transfer tubes and said second passage is substantially concentric with an outlet hole formed through said end plate.

2. The heat exchanger of claim 1, wherein said first and second passages are formed as straight passages, respectively.

3. The heat exchanger of claim 1, wherein each of said plurality of heat transfer tubes is formed by a pair of tube plates.

4. The heat exchanger of claim 1, wherein said tanks are formed integrally with said plurality of heat transfer tubes.

5. A stacking-type, multi-flow, heat exchanger comprising a heat exchanger core comprising a plurality of heat transfer tubes and a plurality of fins, which are stacked alternately, and a pair of tanks, each provided at an end of said plurality of heat transfer tubes, a first tank of said tanks comprising an inlet tank portion through which a heat exchange medium is introduced into said heat exchanger core, and an outlet tank portion, through which said heat exchange medium is discharged from said heat exchanger core, said heat exchanger comprising:

a flange member connected to said first tank, said flange member comprising a flange body, an inlet pipe portion communicating with said inlet tank portion and an outlet pipe communicating with said outlet tank portion, at least one of said inlet pipe and said outlet pipe being formed separately from said flange body; and a first passage for introducing said heat exchange medium from said inlet pipe to said inlet tank portion and a second passage for discharging said heat exchange medium from said outlet tank portion to said outlet pipe, said first and second passages being arranged in a thickness direction of said heat exchanger in parallel to each other, wherein said flange member is connected to an end plate, which is provided as an outermost layer of said heat exchanger core in a stacking direction of said heat transfer tubes and fins, via a flange stay.

6. The heat exchanger of claim 5, wherein a claw is provided on said flange stay for temporarily fixing said flange stay to said end plate.

7. The heat exchanger of claim 1, wherein said heat exchanger is an evaporator of refrigerant.

* * * * *